US006719496B1

(12) United States Patent
Von Eberstein

(10) Patent No.: US 6,719,496 B1
(45) Date of Patent: Apr. 13, 2004

(54) ROV INSTALLED SUCTION PILES

(75) Inventor: William Henry Von Eberstein, Slidell, LA (US)

(73) Assignee: Shell Oil Company, Houston, TX (US)

( * ) Notice: Subject to any disclaimer, the term of this patent is extended or adjusted under 35 U.S.C. 154(b) by 648 days.

(21) Appl. No.: 09/183,100

(22) Filed: Nov. 2, 1998

Related U.S. Application Data

(60) Provisional application No. 60/063,976, filed on Nov. 1, 1997.

(51) Int. Cl.[7] ..... B63B 21/27

(52) U.S. Cl. ..... 405/224; 114/296

(58) Field of Search ..... 405/244, 224, 405/226, 227, 172, 228; 114/313, 296, 294

(56) References Cited

U.S. PATENT DOCUMENTS

| | | | | | |
|---|---|---|---|---|---|
| 1,694,051 | A | | 12/1928 | Bardon | 403/353 |
| 3,051,117 | A | | 8/1962 | Hunter | |
| 3,066,371 | A | | 12/1962 | Mullens | 403/353 X |
| 3,263,641 | A | * | 8/1966 | Stimson | 114/296 |
| 3,295,489 | A | | 1/1967 | Bossa | 114/230 |
| 3,361,200 | A | * | 1/1968 | Chambers | 166/348 |
| 3,411,473 | A | | 11/1968 | Mott et al. | 114/296 |
| 3,431,879 | A | * | 3/1969 | Westling | 114/294 |
| 3,496,900 | A | * | 2/1970 | Mott et al. | 114/296 |
| 3,540,396 | A | | 11/1970 | Bossa | 114/230 |
| 3,572,041 | A | | 3/1971 | Graaf | 61/46.5 |
| 3,602,174 | A | | 8/1971 | Gorman | 114/230 |
| 3,703,151 | A | | 11/1972 | Clement | 114/230 |
| 3,831,387 | A | * | 8/1974 | Rolleman | 405/191 |
| 3,846,991 | A | * | 11/1974 | Wisotsky | 405/228 |

(List continued on next page.)

FOREIGN PATENT DOCUMENTS

| | | | |
|---|---|---|---|
| EP | 011894 | A | 6/1980 |
| FR | 2503084 | A | 10/1982 |
| SU | 610714 | | 5/1978 |
| SU | 610714 | | 6/1978 |
| SU | 797955 | | 1/1981 |
| WO | 95/20075 | | 7/1995 |
| WO | 99/64684 | | 12/1999 |

OTHER PUBLICATIONS

Listing of Possible Suction Anchor Installations Using ROV Pumping Devices, undated.

Dr. Tom R. Guttormsen, Saga Petroleum ASA, "Installation and Retrieval of Suction Anchors", undated.

(List continued on next page.)

*Primary Examiner*—John Kreck

(57) ABSTRACT

A method is disclosed for deploying a suction pile anchor in which flood valves are opened on the top of a suction pile and the suction pile anchor is off loaded from the anchor boat and lowered it to the sea floor. The suction pile anchor is set down and the rate of feed is adjusted to match the rate of self-penetration. An ROV with pump capability closes the flood valves on the top of the suction pile and attaches to the pumping port of the suction pile. The pump of the ROV operates to draw down the suction pile to full depth and brings the first load line connection and the attached first end of the load line well below the mudline while the second load connection at the second end of the load line is supported above the mudline. The ROV disconnects from the pump port and connects a mooring line to second the load connection. Another aspect of the present invention is a suction pile system having a suction pile with an ROV compatible pressure port and a flood valve at the top. A load support system includes a first load connection on the side of the suction pile with a load line connected to the first load connection. A second, ROV accessible load connection is provided at the distal end of the load line.

4 Claims, 12 Drawing Sheets

U.S. PATENT DOCUMENTS

| | | | | | |
|---|---|---|---|---|---|
| 3,851,492 | A | * | 12/1974 | Cannon et al. | 405/191 |
| 3,927,636 | A | | 12/1975 | Childers et al. | 114/230 X |
| 3,928,982 | A | * | 12/1975 | Lacroix | 405/224 |
| 3,931,782 | A | | 1/1976 | Childers et al. | 114/230 X |
| 3,967,572 | A | | 7/1976 | Lea | 114/230 X |
| 4,024,718 | A | | 5/1977 | Roche et al. | 405/190 |
| 4,067,282 | A | | 1/1978 | Guinn et al. | |
| 4,086,866 | A | | 5/1978 | Nixon | 114/295 |
| 4,164,195 | A | | 8/1979 | Frigeni | 114/322 |
| 4,215,544 | A | * | 8/1980 | Stanwick | 60/398 |
| 4,222,591 | A | | 9/1980 | Haley | 285/920 X |
| 4,257,721 | A | | 3/1981 | Haynes | 405/227 |
| 4,270,480 | A | | 6/1981 | Hancock et al. | 114/296 |
| 4,318,641 | A | | 3/1982 | Hogervorst | 405/224 |
| 4,347,012 | A | | 8/1982 | Glidden | 403/2 |
| 4,432,671 | A | * | 2/1984 | Westra et al. | 405/226 |
| 4,435,108 | A | * | 3/1984 | Hampton | 405/209 |
| 4,439,068 | A | | 3/1984 | Pokladnik | 166/338 X |
| 4,471,709 | A | * | 9/1984 | Chun | 114/293 |
| 4,476,802 | A | * | 10/1984 | Poldervaart et al. | 114/296 |
| 4,509,448 | A | | 4/1985 | Pease et al. | 114/293 |
| 4,516,882 | A | * | 5/1985 | Brewer et al. | 405/224 |
| 4,575,282 | A | * | 3/1986 | Pardue, Sr. et al. | 405/228 |
| 4,601,608 | A | | 7/1986 | Ahlstone | 285/920 X |
| 4,620,820 | A | | 11/1986 | Collipp | 405/224 |
| 4,625,673 | A | | 12/1986 | Faller et al. | 114/230 |
| 4,635,728 | A | | 1/1987 | Harrington | 166/341 |
| 4,674,918 | A | * | 6/1987 | Kalpins | 405/224 |
| 4,683,832 | A | * | 8/1987 | Dysarz | 114/258 |
| 4,687,377 | A | | 8/1987 | Langner | 405/169 |
| 4,721,415 | A | | 1/1988 | Shatto | 405/224.1 |
| 4,724,789 | A | | 2/1988 | Van Den Haak | 114/293 |
| 4,733,993 | A | | 3/1988 | Andréasson | 405/224 |
| 4,784,528 | A | * | 11/1988 | Spalding et al. | 405/226 |
| 4,830,541 | A | | 5/1989 | Shatto | 405/226 |
| 4,940,362 | A | | 7/1990 | Paulshus et al. | 405/224 |
| 5,041,038 | A | | 8/1991 | Poldervaart et al. | 440/5 |
| 5,069,580 | A | | 12/1991 | Herwig et al. | 405/224 X |
| 5,159,891 | A | | 11/1992 | Lohr et al. | 114/230 |
| 5,168,823 | A | | 12/1992 | Sheppard, Jr. | 114/293 X |
| 5,390,618 | A | | 2/1995 | Wolff et al. | 114/293 X |
| 5,480,521 | A | | 1/1996 | Snyder et al. | 166/338 X |
| 5,615,630 | A | | 4/1997 | Eronen et al. | 114/251 |
| 5,704,307 | A | | 1/1998 | Treu et al. | 114/230 |
| 5,704,732 | A | | 1/1998 | Horton, III | 405/228 |
| 5,836,061 | A | | 11/1998 | Castillo et al. | 403/353 X |
| 5,855,178 | A | * | 1/1999 | Treu et al. | 114/230 |
| 5,915,326 | A | * | 6/1999 | Karal | 114/294 |
| 5,927,904 | A | * | 7/1999 | Treu et al. | 405/224 |
| 5,979,353 | A | * | 11/1999 | Borseth | 114/293 |
| 5,992,060 | A | | 11/1999 | Treu et al. | 37/345 |
| 6,003,466 | A | | 12/1999 | Dove et al. | 114/293 |
| 6,009,825 | A | | 1/2000 | Fulton et al. | 114/296 |
| 6,106,198 | A | * | 8/2000 | Borseth | 405/223.1 |

OTHER PUBLICATIONS

StatOil List—Suction Anchor Installations, 2000.

Samy Alhayari, Single Buoy Moorings Inc., Innovative Developments in Suction Pile Technology OTC Proceedings, 1998 Offshore Technology Conf., pp. 1–21.

Mark E. Riemers et al, Examining the Development and Capabilities of the Alternative Suction Embedded Anchor (SEA) in Deep and Ultra Deepwater, Suction Pile Technology, pp. 1–9, undated.

Per Sparrevik, "Suction Anchor Piles", Preprint–Mooring and Anchoring Conf., Aberdeen, 10–11 J 1996, pp. 1–9.

"Suction Anchor Installation Services from NGI–FRAMO", pp. 1–4, 1999.

J. L. Colliat et al, "Design and Installation of Suction Anchor Piles at a Soft Clay Site in Gulf of Guinea", Offshore Technology Conf., 1996, pp. 325–337.

D. Hagen et al, "Innovative Suction Anchor Design and Installation", Offshore Technology Conf. 1998, pp. 1–15.

Peter Dove and Helge Roraas, Aker Marine Contractors, "Experience With The Installation of De Water Polyester Moorings and New Generation Anchors", Nov. 1999, pp. 1–10.

Per Sparrevik and Frank Myrvoll, "How Suction Anchors Have Advanced", Norwegian Geotechnical Inst., Jun. 1997.

C. Chimisso et al., "Deepwater FPSO for Aquila Field Development in the Adriatic", OTC 8808, 1998, pp. 259–267.

Telefax memo from Aker Omega Marine, Inc. to Shell Offshore, Inc. dated May 7, 1991.

Telefax memo from Aker Omega Marine, Inc. to Shell Offshore, Inc. dated Jun. 17, 1991.

Peter G. S. Dove et al, Aker Marine Contractors, Pre–Set Moorings Provide Less Costly Alternative to DP in Ultra–Deepwater, *Offshore*, May 1997, pp. 76–80.

Thomas M. Fulton, "Why Mobile Drilling Units Will Be Able to Moor in 10,000 ft. Depths", Offshore, Apr. 1997.

J. R. Hogervorst, "Field Trails With Large Diameter Suction Piles", Offshore Technology Conf., 1980.

"Taut Legs Tested In Rig Role", Offshore Engineer, Nov., 1996.

"Moorings Descend Deeper", Offshore Engineer, Mar. 1997.

D. Senpere & G. A. Auvergne, Suction Anchor Piles—A Proven Alternative to Driving or Drilling, Offshore Technology Conf., 1982.

S. Fines & O. J. Stove, "Snorre TLP Tethers and Foundation", Offshore Technology Conf., 1991.

Hans P. Christophersen, "The Non–Piled Foundation Systems of the Snorre Field", Society for Underwater Technology, 1993.

J. L. Colliat et al, "Caisson Foundations As Alternative Anchors for Permanent Mooring of a Process Barge Offshore Congo ", Offshore Technology Conf., 1995.

J. L. Colliat et al, Design and Installation of Suction Anchor Piles at a Soft Clay Site in the Gulf of Guinea, Offshore Technology Conf., 1996.

Per Sparrevik, "Suction Anchor Piles", Mooring and Anchoring Conf., Aberdeen , Jun. 1996.

Sherif El–Gharbawy, The Application of Suction Caissons for Deepwater Mooring Offshore West Africa, 3rd Annual Pennwell Offshore W. Africa Conf. (Abidjan), Mar. 1999.

Sherif L. El–Gharbawy, "Suction Anchor Installations for Deep Guld of Mexico Applications", Offshore Technology Conference, May 1999.

PTC/EP 98/07012 (TH0945 PCT) Search Report dated Feb. 8, 1999.

T.S. Olberg et al, "Full Scale Field Trial of Taut Leg Mooring Using Fiber Rope and Suction Anchor attached to a Semi Submersible Drilling Unit" IBC Tech Serv Worldwide Deepwater Technology Conf., Feb. 1997.

T.S. Olberg, "Field Trial for Taut Leg Moorings", Journal of Offshore Technology, May 1997.

T.S. Olberg, Full Scale Field Trial of Taut Leg Mooring Using Fiber Rope and Suction Anchor Attached to a Semi–Submersible Drilling Unit, Offshore Technology Conference, May 1997.

* cited by examiner

FIG. 15
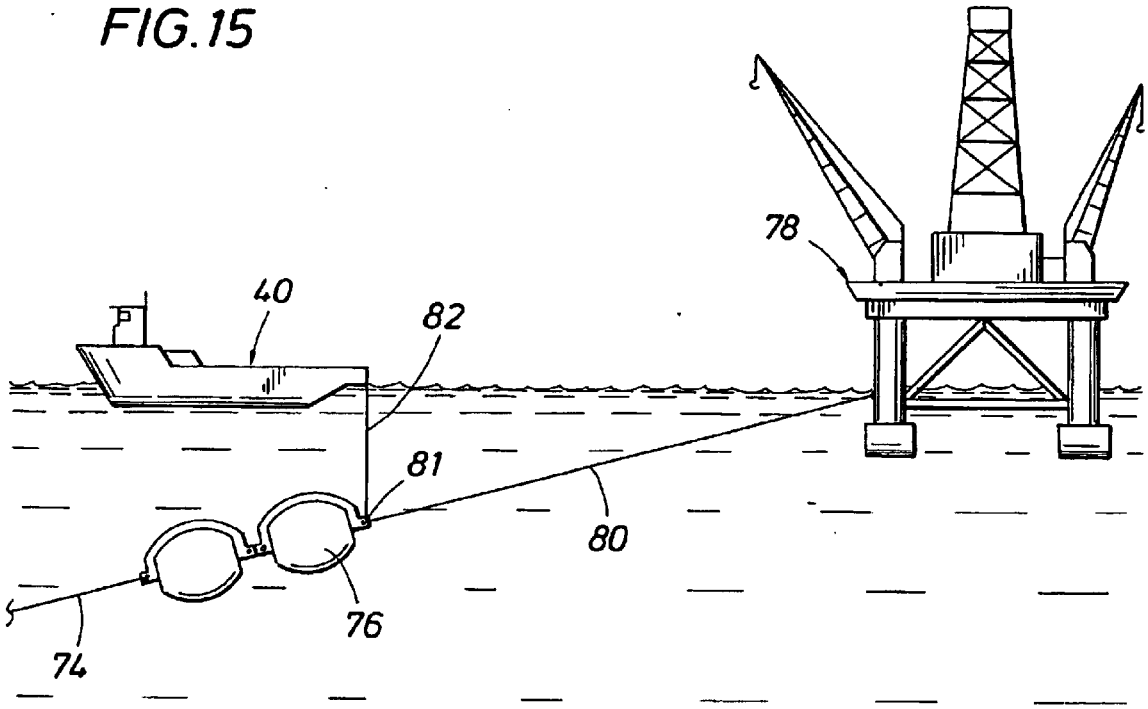
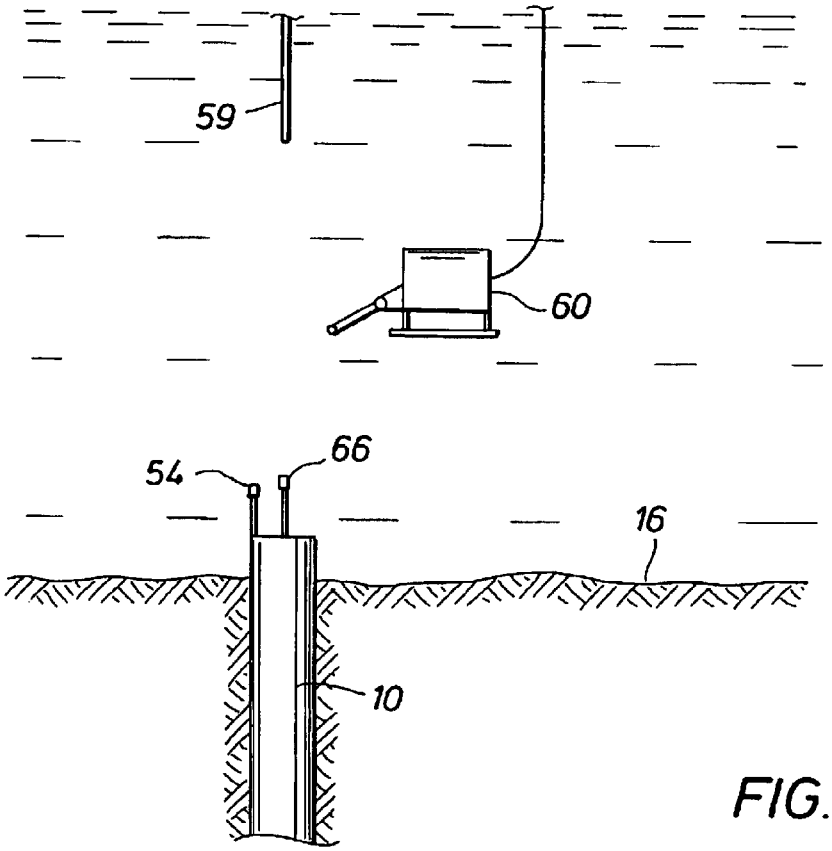
FIG. 16

FIG. 19
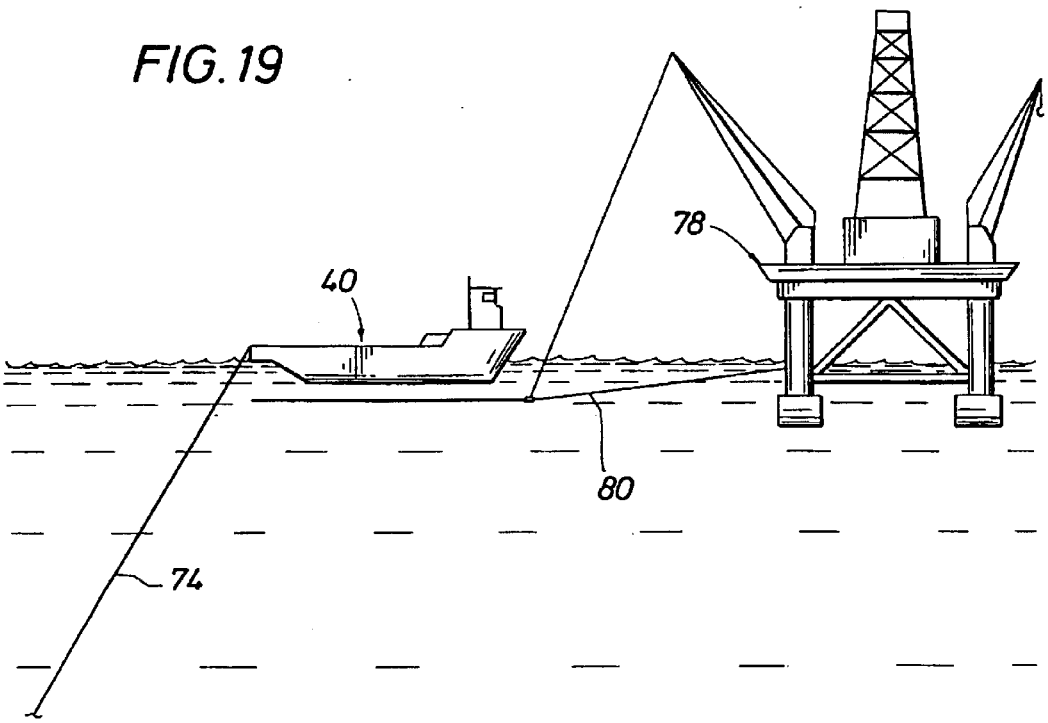
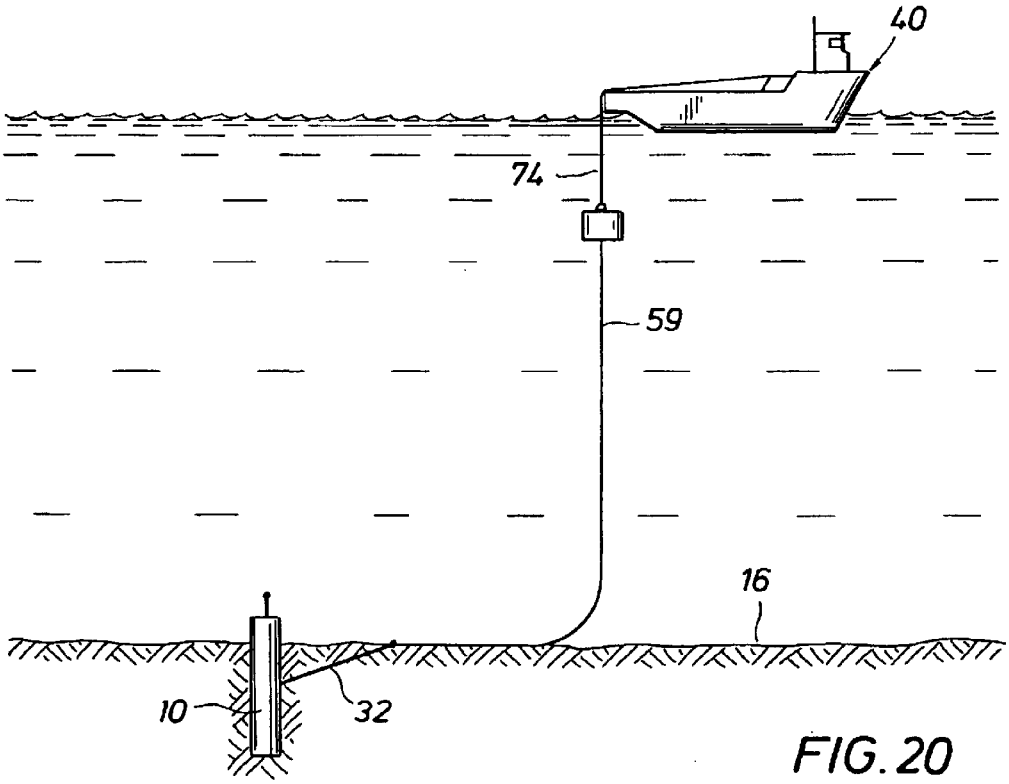
FIG. 20

ROV INSTALLED SUCTION PILES

This application claims the benefit of Provisional application No. 60/063,976 filed Nov. 1, 1997.

BACKGROUND OF THE INVENTION

The present invention relates to a method and system for securing offshore vessels and structures and, more particularly, to anchoring offshore drilling and/or production vessels in relation to the ocean floor.

Surface facilities must be maintained in position over a well site for offshore drilling operations and often for production operations. This often requires the deployment of an array of mooring lines, each anchored to the seabed with a pile foundation or the like. Installing such foundation elements for secure anchorage is time consuming and requires considerable offshore equipment.

Another problem arising in deepwater is that the spread of these mooring lines can be substantial and anchor structures are widely placed over a leasehold or even into adjacent lease blocks and the mooring arrays of adjacent blocks can overlap. Further, the sequential steps in development such as exploration wells, test wells, satellite subsea wells, etc. can each leave foundation elements until the seafloor actually becomes crowded in relation to the necessary infrastructure for working offshore prospects.

Suction anchors as disclosed in U.S. Pat. No. 4,318,641 have been known as a method for installing tubular elements into the seabed. This provides an alternative to driving or drilling and grouting piles and provides opportunity for easier installation, but the installation is remains equipment intensive and does not facilitate foundation removal.

Thus, there remains a need for a method and system for anchoring offshore structures and vessels which further facilitates ease of deployment with a minimum of equipment.

A SUMMARY OF THE INVENTION

One aspect of the present invention is a method for deploying a suction pile anchor in which flood valves are opened on the top of a suction pile and the suction pile anchor is off loaded from the anchor boat and lowered it to the sea floor. The suction pile anchor is set down and the rate of feed is adjusted to match the rate of self-penetration. An ROV with pump capability closes the flood valves on the top of the suction pile and attaches to the pump port of the suction pile. The pump of the ROV operates to draw down the suction pile to full depth and brings the load pad-eye and the attached first end of the load line well below the mudline while the load connection at the second end of the load line is supported above the mudline. The ROV disconnects from the pump port and connects a mooring line to the load connection.

Another aspect of the present invention is a suction pile system having a suction pile with an ROV compatible pressure port and a flood valve at the top. A load support system includes a first load connection on the side of the suction pile with a load line connected to the first load connection and a second load connection connected to the end of the load line. An installation support system is included having an installation connection on the top of the suction anchor pile.

A BRIEF DESCRIPTION OF THE DRAWINGS

The brief description above, as well as further objects and advantages of the present invention, will be more fully appreciated by reference to the following detailed description of the preferred embodiments which should be read in conjunction with the accompanying drawings in which:

FIG. 15 is a side elevational view of steps connecting a mooring line to a rig;

FIG. 16 is a side elevational view of an alternate deployment of a suction pile anchor;

FIG. 19 is a side elevational view of retrieving the rig mooring line and beginning retrieval of the intermediate mooring line;

FIG. 20 is a side elevational view of the retrieval of the intermediate mooring line;

A DETAILED DESCRIPTION OF ILLUSTRATIVE EMBODIMENTS

Figure 1:
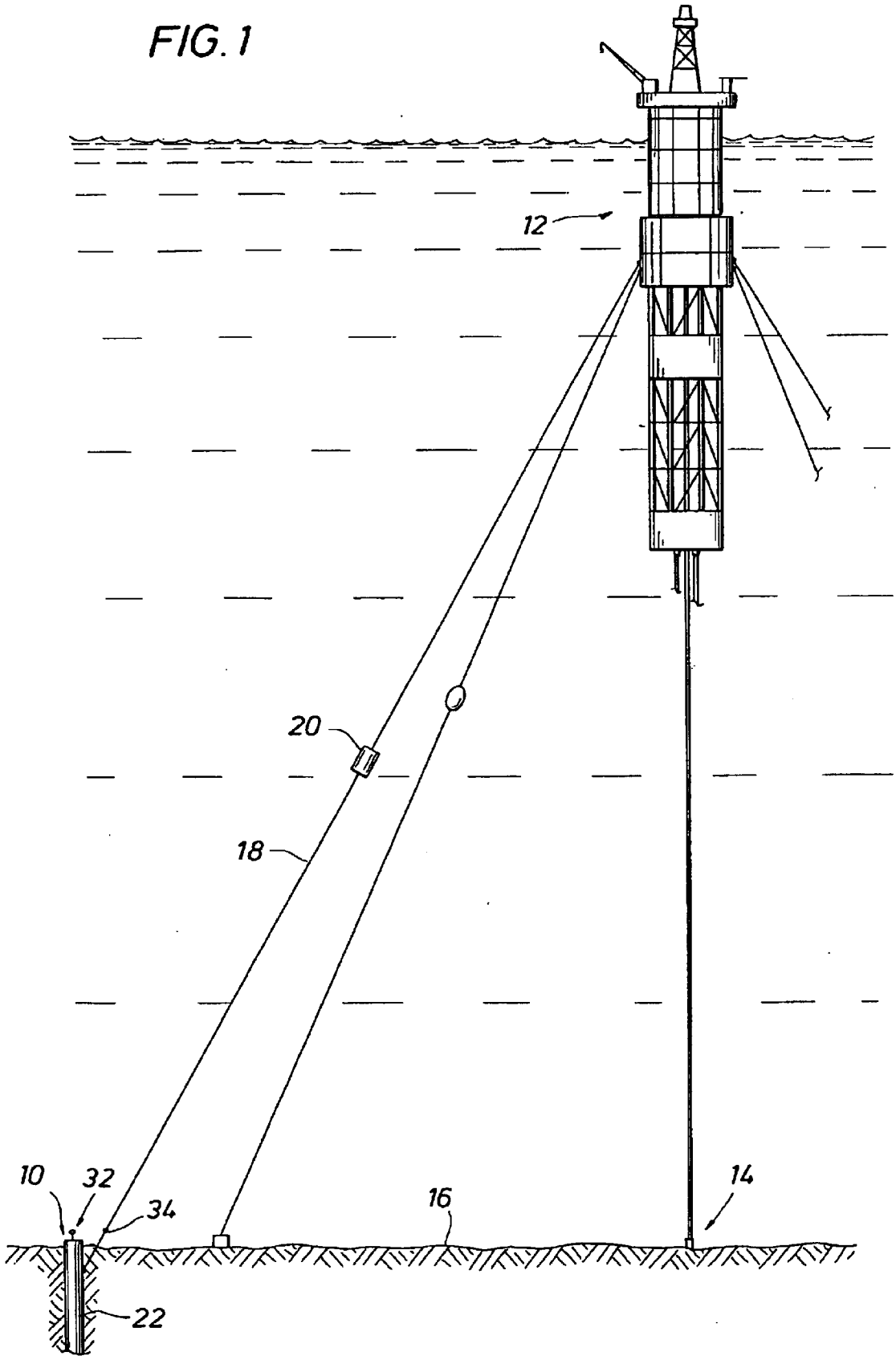
FIG. 1 is a side elevational view of a drilling rig moored with suction pile anchors in accordance with the present invention.

FIG. 1 illustrates one application of the present invention. Here the suction pile anchors 10 secure a truss spar configuration mobile offshore drilling unit ("MODU") 12 in position over well site 14 at ocean floor 16. Each suction pile anchor is securely set within the ocean floor and is connected to MODU 12 through mooring or load lines 18. The use of taut line moorings may reduce the mooring spread. Further, buoys 20 may be included into the mooring lines.

Figure 2A:
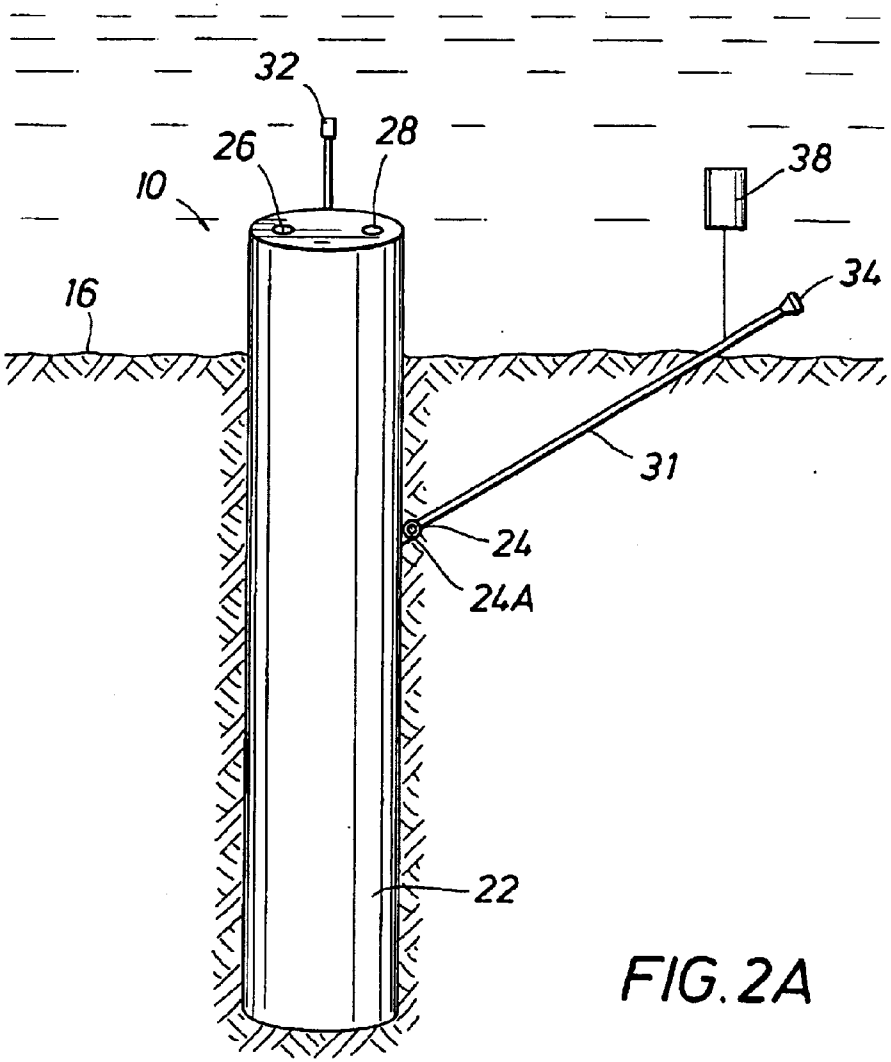
FIG. 2A is a side elevational view of a suction pile anchor in accordance with another embodiment of the present invention.
Figure 2:
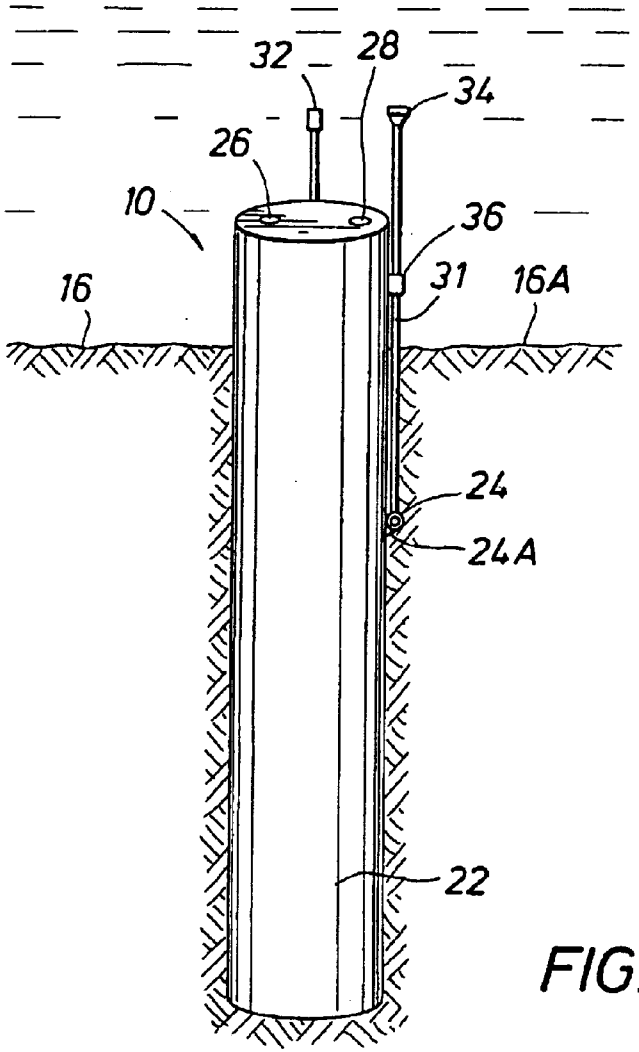
FIG. 2 is a side elevational view of a suction pile anchor in accordance with one embodiment of the present invention.

FIG. 2 illustrates a suction pile anchor 10 installed in ocean floor 16. The suction pile anchor has a suction pile 22, here in the form of a closed top cylinder. A first load connection 24, here provided by load pad-eyes 24A, is provided on the side of the suction pile, positioned to be away from the ends of the suction pile and well below the mud line on deployment. Under load conditions with this configuration, the load will be resisted most efficiently against the mud.

Flooding ports or valves 26 and pump or pressure port or valve 28 are provided through or adjacent the closed top of suction pile 22. Further, these valves are designed to be actuatable with a remotely operated vehicle ("ROV"), not shown. An installation connection 30 is also provided at the top of the suction pile. Here the installation connection includes a lowering and lifting sling 32.

A load line or main mooring wire extension 32 is connected to the first load connection and provides an ROV operable second load line connection 34 above mudline 16A of ocean floor 16. In FIG. 2, main mooring wire extension 32 holds second load line connection 34 in an accessible position through the inherent stiffness of the wire rope over short distances and a load line keeper or wire grabber latch 36.

FIG. 2A illustrates an alternative embodiment in which the accessibility of second load line connection 34 above the mudline is secured with a buoy 38 attached to the main mooring wire extension. FIGS. 3–22 illustrate an installation, deployment into mooring system, and retrieval of suction pile anchors. FIGS. 3–15 illustrate suction pile anchor installation and mooring system deployment. FIGS. 16–22 illustrate retrieval procedures, but his discussion also references installation procedure illustrations as retrieval is, in large measure, the reversal of the installation, deployment steps.

Figure 3:
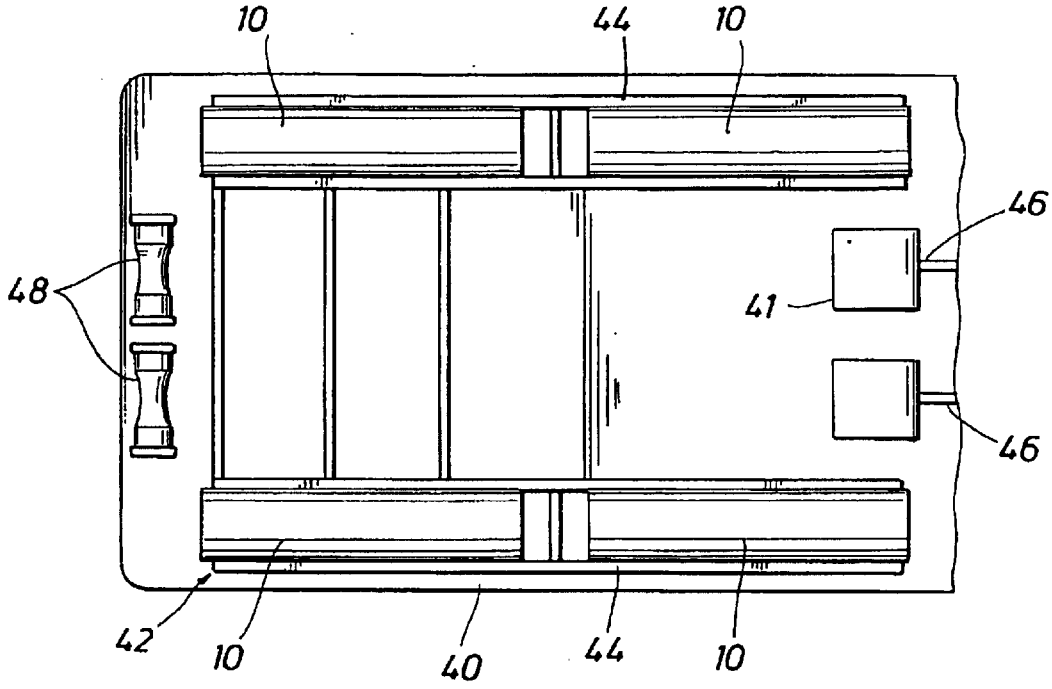
FIG. 3 is a top elevational view of a work deck of an anchor-handling vessel.

FIG. 3 illustrates the work deck of an anchor handling vessel 40 equipped to deliver and deploy four suction pile anchors 10 per excursion. The suction pile anchors are locked into cradles or transport slots 42 and in which horizontal skids 44 provide stability for controlled deployment of the suction pile anchors. Wire 46 is spooled onto winches provided on the deck of anchor handling vessel 40.

Figure 4:
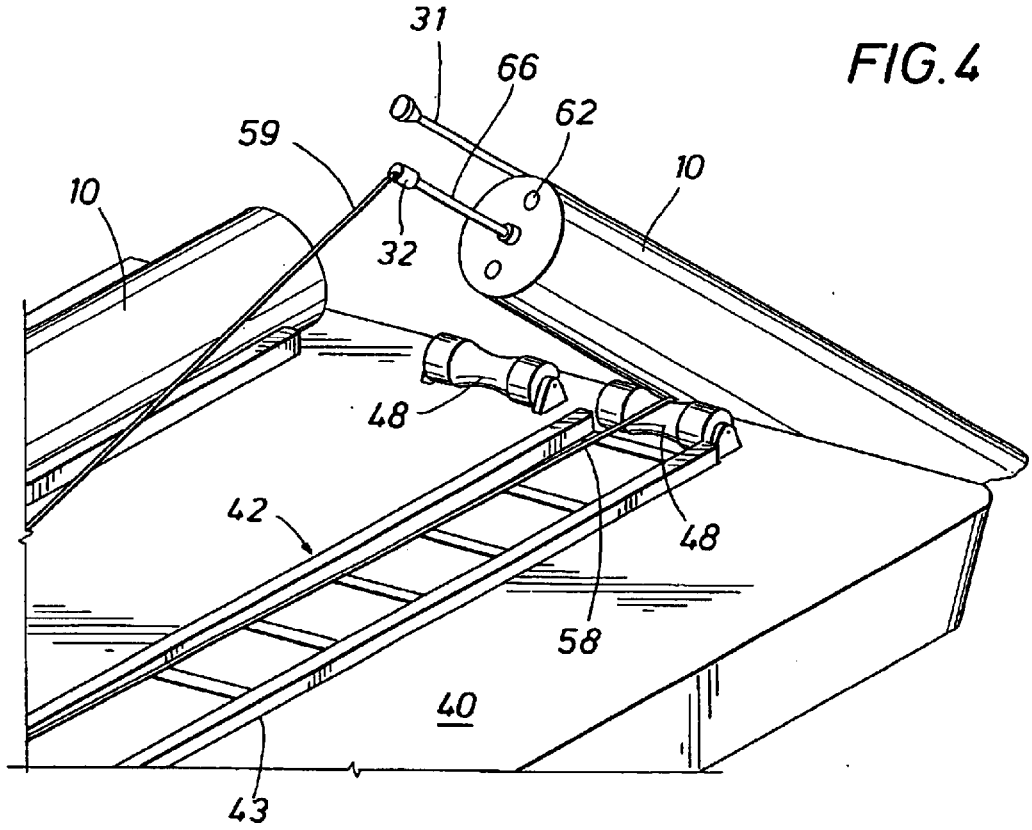
FIG. 4 is a perspective view of a suction pile being off-loaded from the word deck.
Figure 5:
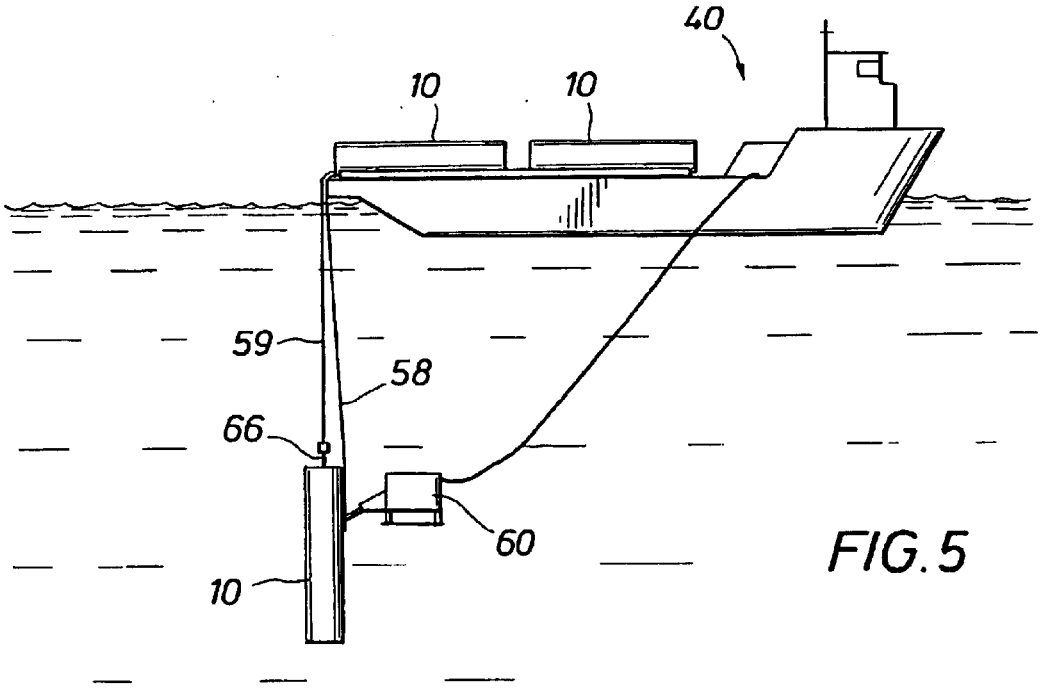
FIG. 5 is side elevational view of a suction pile anchor at the shallow staging area.
Figure 6:
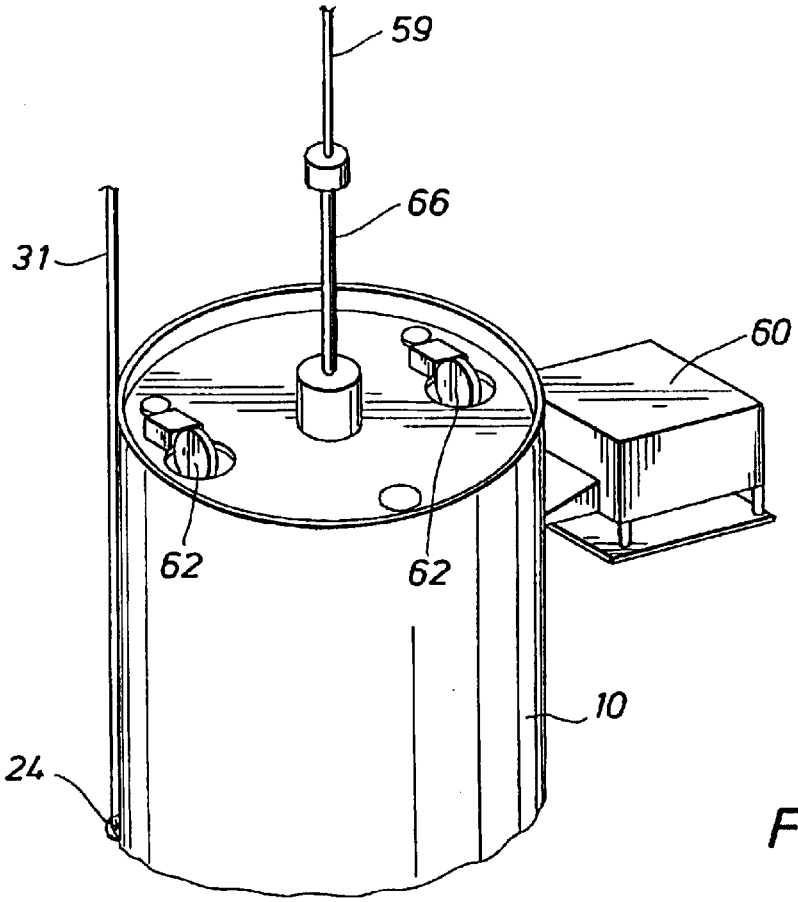
FIG. 6 is a perspective view of an ROV orienting the suction pile anchor.
Figure 7:
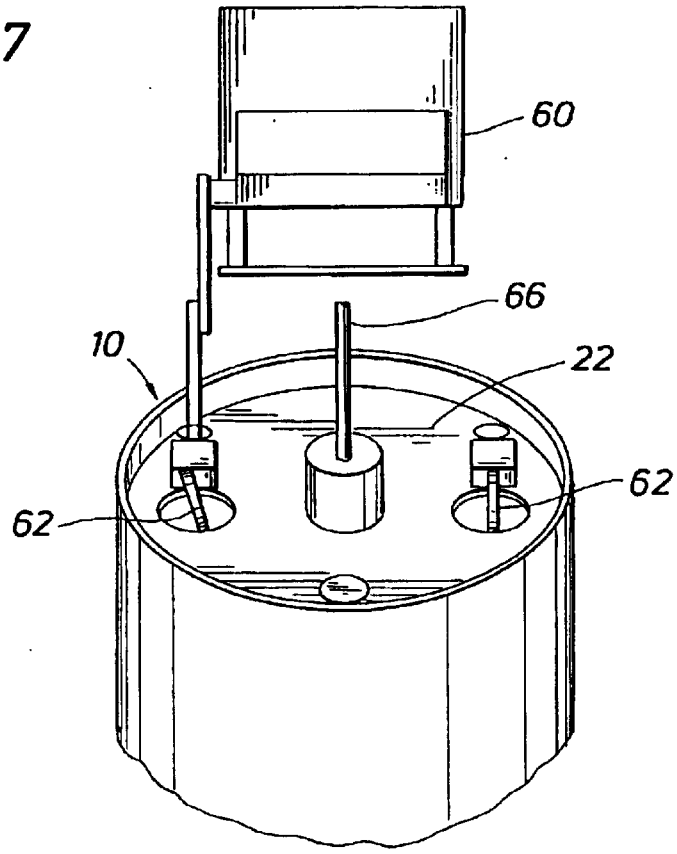
FIG. 7 is a perspective view of an ROV closing flood valve on the top of a suction pile.
Figure 8:
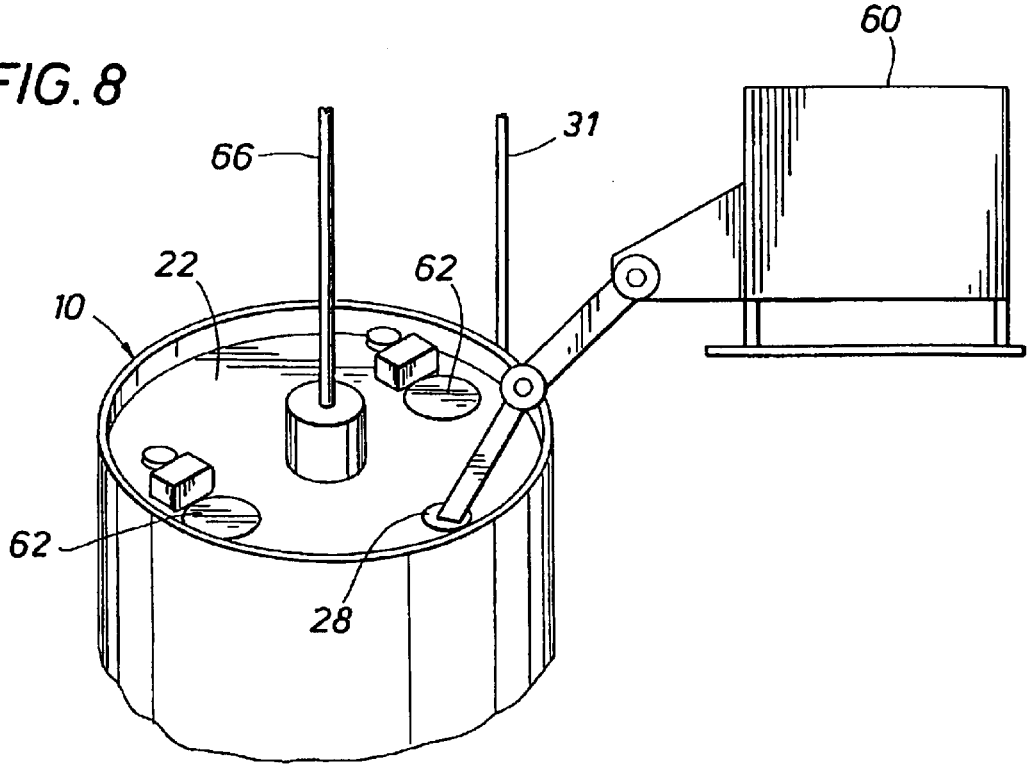
FIG. 8 is a perspective view of a ROV engaging the pump port of a suction pile anchor.
Figure 9:
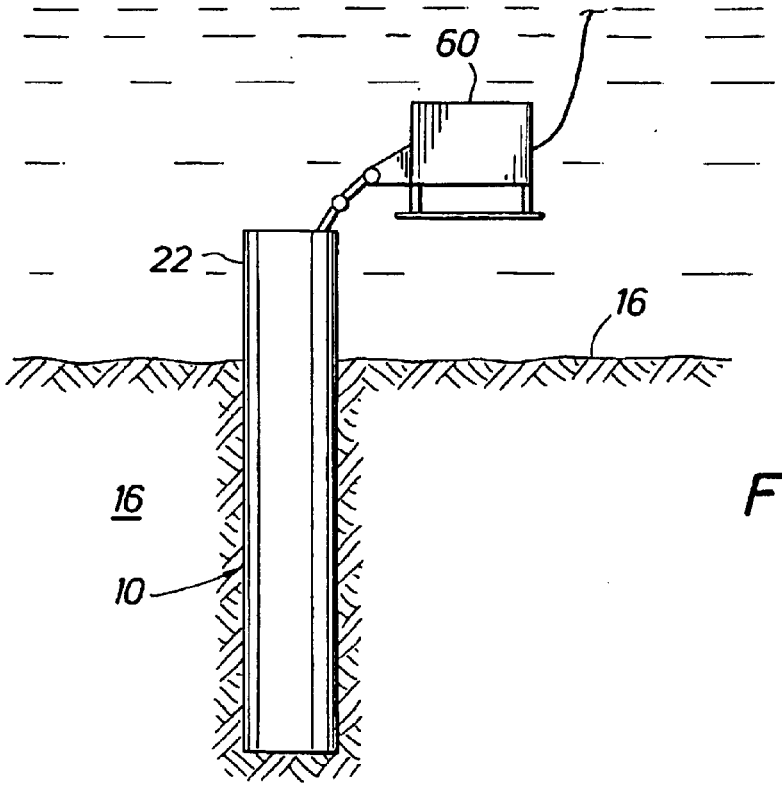
FIG. 9 is a side elevational view of a suction pile anchor installing into the ocean floor.
Figure 10:
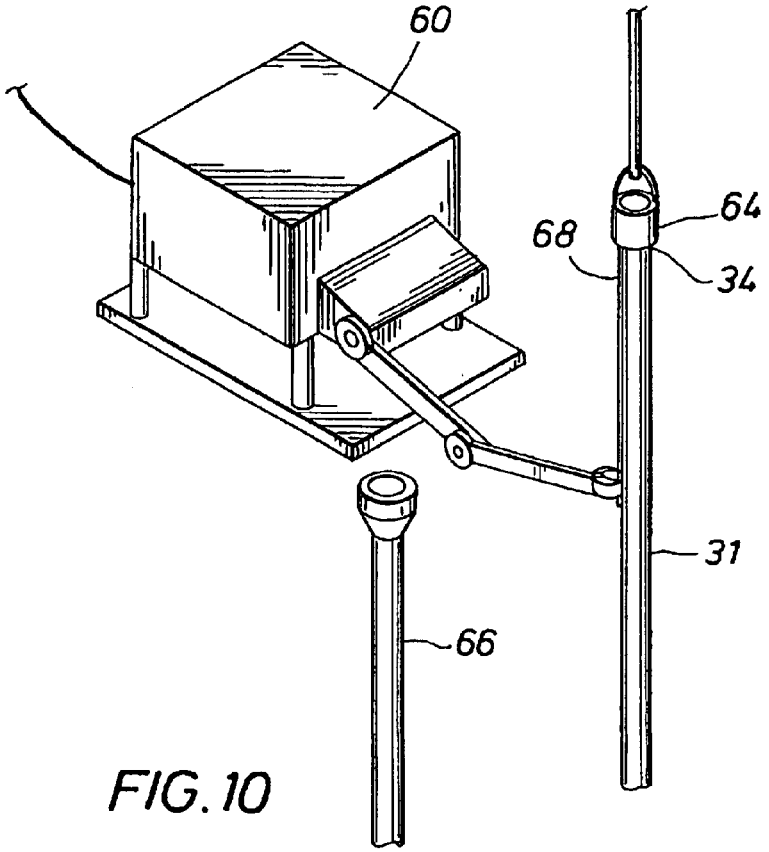
FIG. 10 is a perspective view of an ROV changing line connections on the suction pile anchor.
Figure 11:
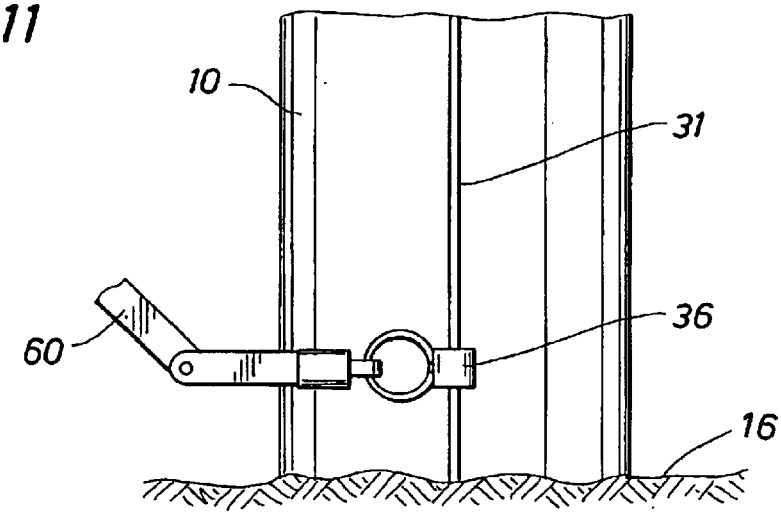
FIG. 11 is a side elevational view of a grabber latch and a main mooring wire extension.
Figure 12:
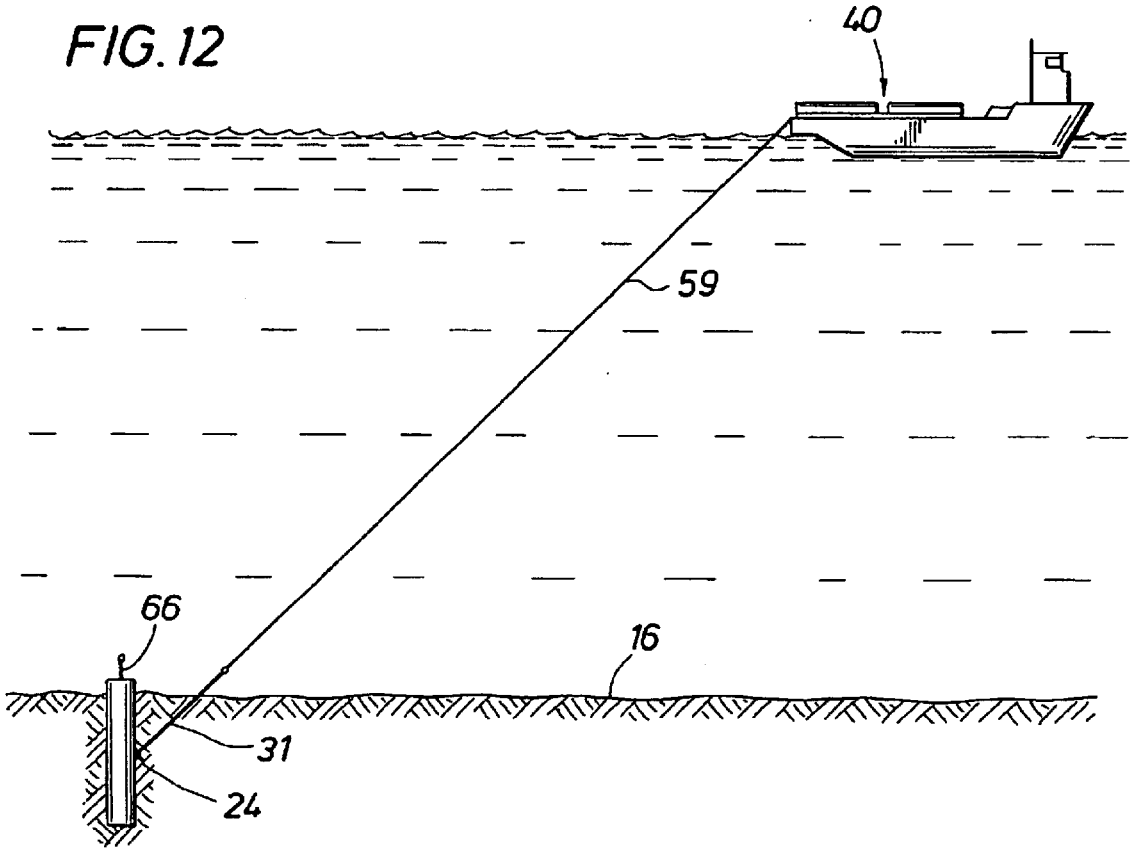
FIG. 12 is a side elevational view of the play out of a primary mooring line.
Figure 13:
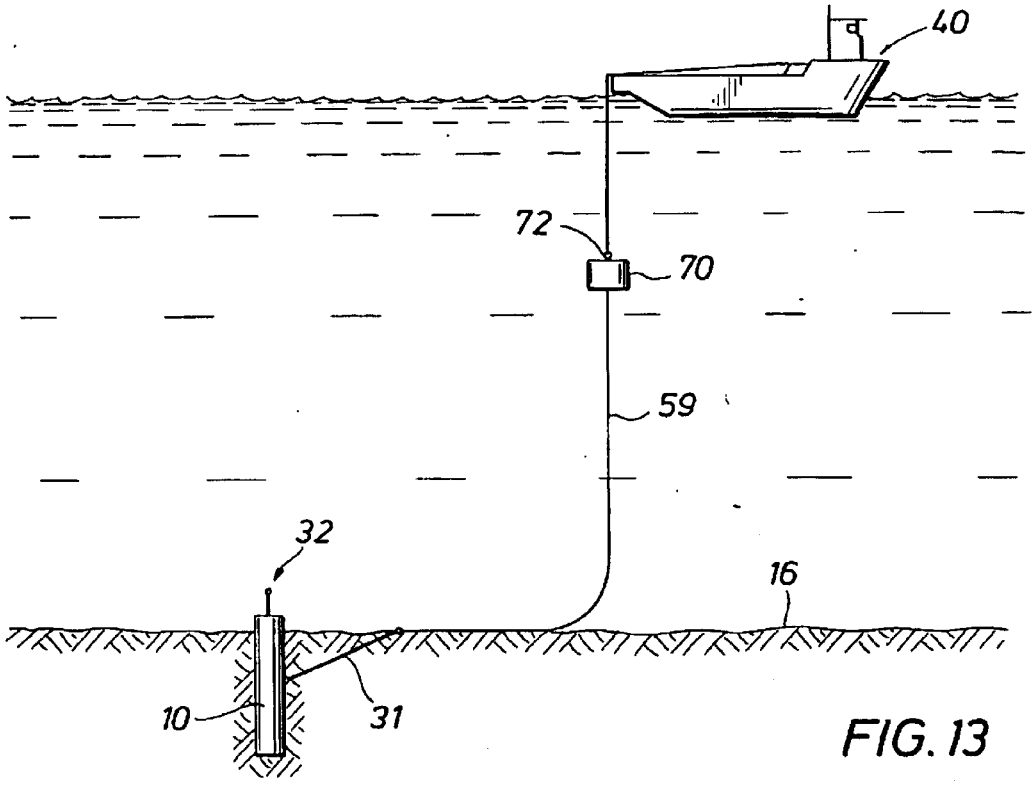
FIG. 13 is a side elevational view of installation of a buoy to the primary mooring line.

Fully loaded, the vessel travels to the installation site and the first suction pile anchor 10 is positioned for deployment. Preferably, this is with a two-way, hydraulically powered track roller assembly 43 which facilitates rapid, smooth suction pile positioning. Referring to FIG. 4, the suction pile anchor smoothly rolls from the vessel, over stern roller 48, and into the water with flooding valves 62 open. At this stage, an overboarding wire 58 supports the weight of suction anchor pile 10. After the anchor clears the stern roller, its weight is accepted by deployment wire 59 connected to lowering and lifting sling 66, see FIG. 5. Descent of the suction pile anchor pauses at a shallow staging station below anchor handling vessel 40 and an ROV 60 is launched from the vessel to disconnect the overboarding hook from the sling.

Descent resumes and ROV 60 follows as suction pile anchor 10 is lowered to a bottom staging station point very near seafloor 16. The suction pile anchor has a tendency to rotate during descent and the ROV may need to properly orient suction pile anchor 10 such that first load connection 24 is aligned with the intended mooring line orientation. See FIG. 6. The suction pile anchor is then lowered for self-penetration under its own weight into the upper silt line of seafloor 16 and into clay muck. In this interval, the play out of deployment were 59 is monitored so that it does not exceed the rate of self-penetration.

At this point ROV 60 attaches itself to the top of suction pile anchor 10 and closes flooding valves 26. See FIG. 7. Continuing with FIG. 8, the ROV then engages pump valve 28 pumps within the ROV begin evacuating water within suction pile 22 and deployment wire 59 plays out with suction pile anchor penetration. The ROV continues monitoring the penetration rate, attitude (leveling), and pressure deferential. See FIG. 9. Once full penetration is then achieved, the ROV closes the pump valve and disengages from the suction pile anchor. Next, the remote operating vehicle assists in the release of the ROV operable subsea connector 64 from the lowering and lifting sling 66. The ROV maneuvers the subsea connector to second load line connection 34 a top main mooring wire extension 32 and attaches it. The subsea connector can be a keyhole-slot engagement secured with a keeper gate across the opening which can be manipulated by pulling on handles 68 in shifting the subsea connector. See FIG. 10.

Once the connection of the main lowering wire or deployment wire 59 to the second load line is secure, the ROV 60 disengages wire grabber latch 36 on the upper portion of the suction pile anchor. See FIG. 11. The ROV then returns to the installation or anchor-handling vessel 40 at the surface. The installation vessel then plays out main mooring wire 59 to seafloor 16 (see FIG. 12) along a predetermined bearing while driving forward and pulling main mooring wire extension 32 taut through the muck. A syntactic foam buoy block and sling assembly 70 is installed into the main mooring wire and the assembly is lowered with the deployment wire. Buoy assembly 70 suspends the end of the wire above seafloor 16 where it remains accessible for recovery and deployment into a mooring array.

In the procedure of this embodiment, ROV 60 is deployed to disconnect deployment hook 72, and both the hook and the ROV are recovered to the vessel and the vessel proceeds to install the next suction pile anchor. This process is repeated until all suction pile anchors are set.

Figure 14:
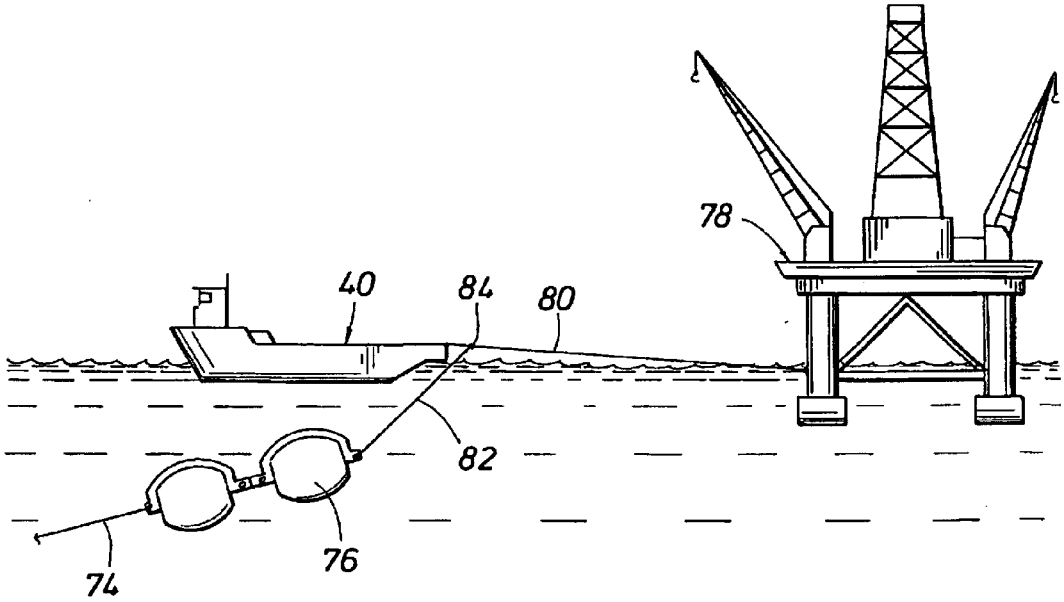
FIG. 14 is a side elevational view of steps connecting a mooring line to a rig.
Figure 17:
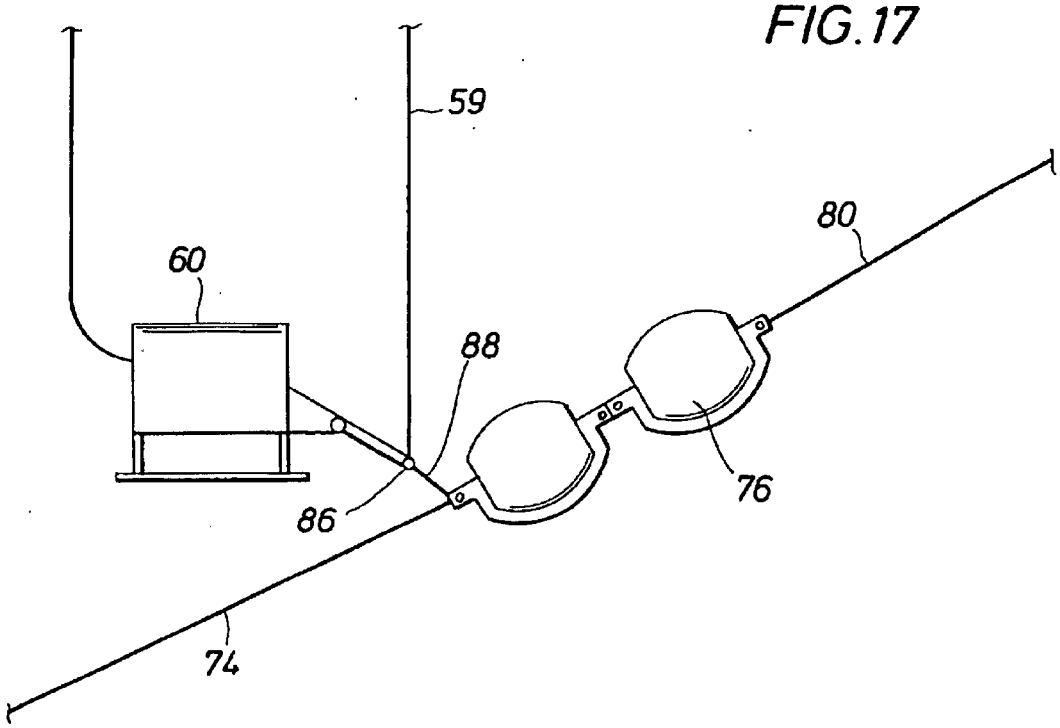
FIG. 17 is side elevational view of initial steps in removing a mooring line from the rig.
Figure 18:
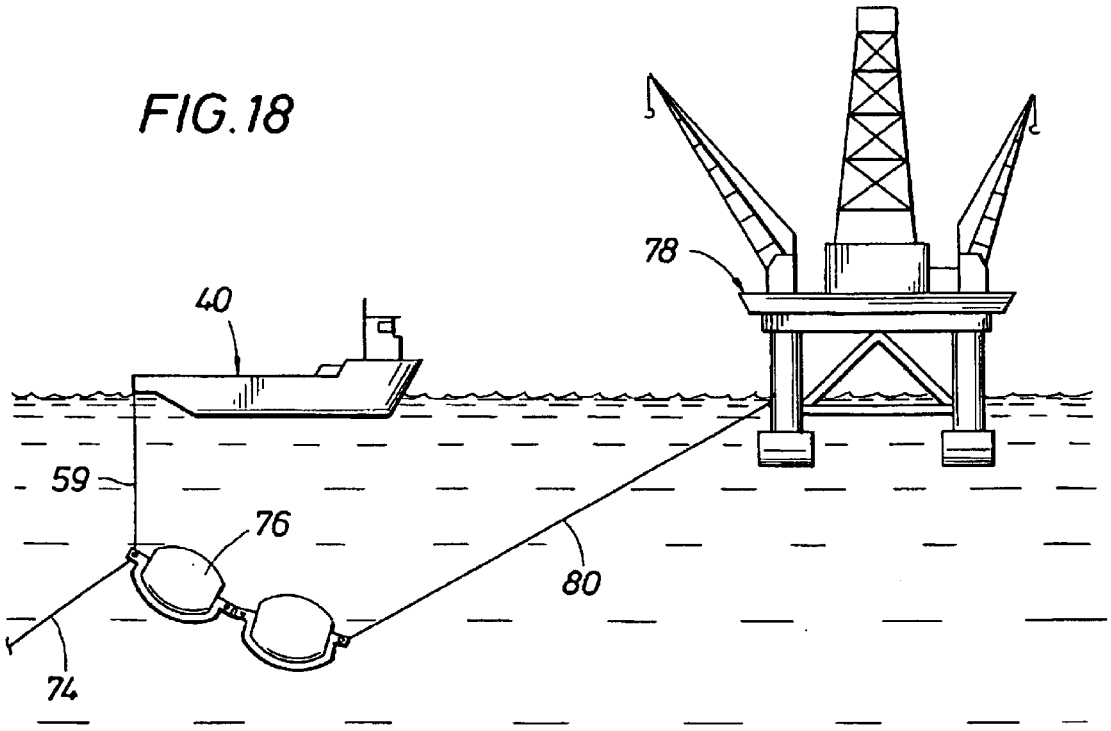
FIG. 18 is a side elevational view of steps to retrieve buoys from the mooring system.
Figure 21:
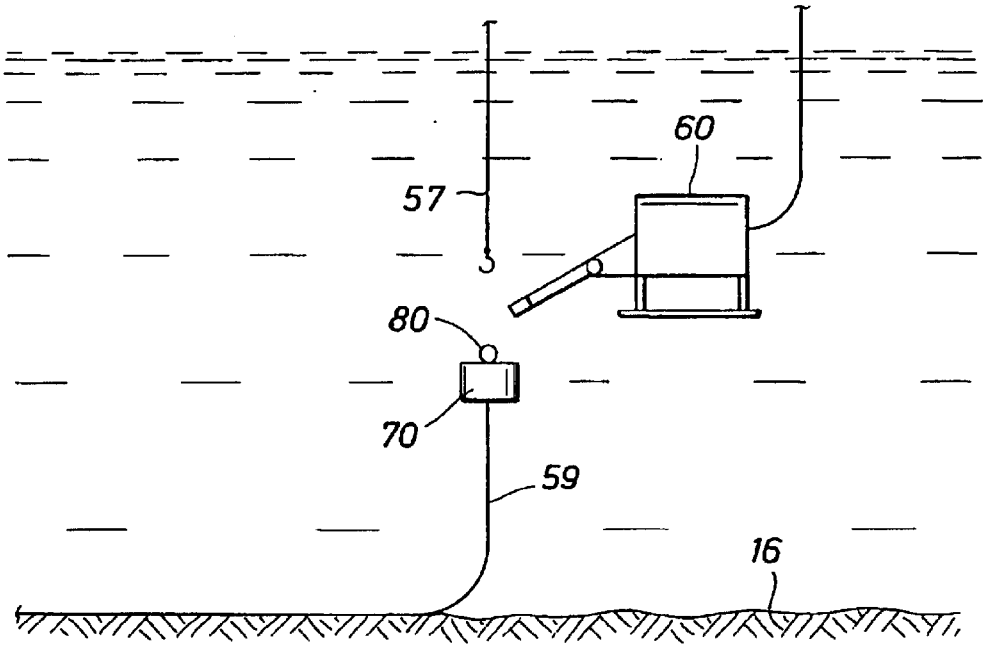
FIG. 21 is a side elevational view of preparations to retrieve the primary mooring line.
Figure 22:
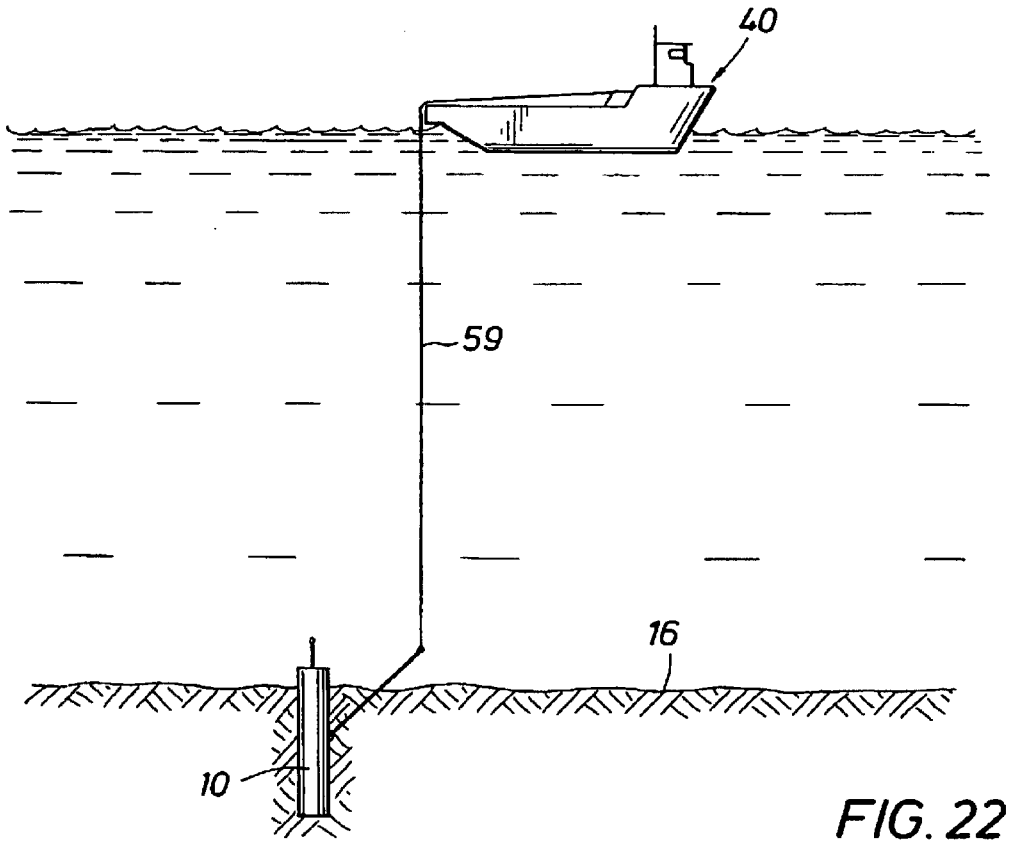
FIG. 22 is a side elevational view of primary mooring line retrieval.

FIG. 14 illustrates the connection of mooring lines from a suction pile anchor to a drilling unit, here in the form of a semisubmersible drilling vessel, rig 78. The anchor-handling vessel arrives loaded with wire and buoys to complete the mooring system for rig 78. Recovery hook 72 is dropped and the ROV deployed to connect the lift wire 59 to the predeployed main mooring wire section. Terminal buoy 70 may be provided with a transponder to facilitate location and hook-up. The lift wire is retrieved to anchor handling vessel 40 and intermediate segment of mooring wire 74 is installed. The intermediate wire is then deployed into the water and syntactic foam buoys 76 are connected and deployed overboard. An upper winch wire 82 is connected to buoys 76 and played out while anchor handling vessel 40 back into rig 78 to receive the rig wire 80. The vessel heaves back and rig wire 80 is connected to buoys 76. The buoys and rig wire are lowered with a j-lock chaser 84, allowing the rig to pre-tension the wire. Vessel 40 then returns to rig 78, lowering the wire, and allowing j-lock chaser 84 to disengage. The procedure is repeated for each additional anchor.

As an alternative, the use of subsea wire socket connector 64 (recall FIG. 10) which is well suited to ROV operation makes it possible to predeploy suction anchors with no main mooring wires. See FIG. 15. This enables the anchor handling vessel 40 to deploy a suction pile 10, disconnect all lines with an ROV 60 and proceed with setting other suction pile anchors. Later the anchor-handling vessel returns to install the mooring wire. This optional procedure is useful when a time constraints exist. A vessel 40 can be loaded with four suction pile anchors 10 and only one deployment wire 59. Sets of four or eight suction pile anchors are installed in batch operations and as are mooring lines after the array of anchors has been set.

Anchor handling vessel 40 returns to location when drilling and/or production operations are over and it is time to mover rig 78. Vessel 40 lowers a recovery hook 86 on line 59, and ROV 60 is deployed to connect the recovery hook to recovery sling 88 below buoy assembly 76. See FIG. 17. Rig 78 then slacks off rig mooring line 80, line 59 is taken in, and the anchor-handling vessel heaves the first buoy of assembly 76 on deck using recovery sling 88. See FIG. 18. The second buoy is decked in a similar manner, and secured. Rig wire 80 is disconnected from buoy assembly 76 and anchor handling vessel 40 returns the rig mooring wire to rig 78. See FIG. 19. Thereafter, recover of intermediate mooring extension wire 74 proceeds with vessel 40 backing up and winching line 74 aboard over the stern roller. See FIG. 20.

It may be desirable to disconnect rig 78 and to retrieve intermediate mooring lines 74 in batch operations, doing this stage for each suction anchor pile 10 before returning to retrieve primary mooring wires 59 in a subsequent batch operation. In such batch operations, anchor handling vessel 40 returns primary mooring line 59 the seafloor 16 with a syntactic buoy 70 in place with a recovery sling 90. See FIG. 21. Again, it may prove convenient to provide buoy 70 with a transponder to facilitate ROV location.

Primary mooring wire recovery operations begin with deployment of ROV 60 and a retrieval line 57 from anchor handling vessel 40. See FIG. 21. The ROV inserts hook 92 at the end of recovery wire into the eye of the recovery sling 90 attached to main mooring wire 59. Backing up, the vessel uses its winch to retrieve first retrieval wire 57 and then primary mooring wire 59 over the stern roller until the vessel is over suction pile anchor 10 and primary mooring wire 59 is substantially vertical. See FIG. 22. The line is then aligned with the entrapment slot, part of keeper 36 on suction pile anchor 10. Recall FIG. 11. Once wire 59 is guided into keeper or latch 36, ROV 60 engages the lock.

ROV 60 then disconnects subsea connector 64 from the second load connection 34 on main mooring extension 32 and connects line 59 to lowering and lifting sling 66 presented by suction pile anchor 10. ROV 60 connects to pump port 28 and the pump system of the ROV injects water back into suction pile anchor 10. While water flows into the suction pile, the ROV directs the winch to begin lifting wire 59. Suction pile anchor 10 is raised in this manner until its bottom is within in close proximity of the silt line. The ROV disengages from pump port 28 and opens flood valves 62. Recall FIGS. 7–9. Retrieval resumes and suction pile anchor 10 is lifted to the surface staging position near the anchor-handling vessel 40. The vessel lowers a tail-boarding hook on line 58 and ROV 60 inserts it into the recovery sling. Recall FIG. 5. The weight of suction pile anchor 10 is accepted by line 58 which is connected to a winch line and ROV 60 is recovered. Vessel 40 proceeds slowly astern as the suction pile anchor is drawn to the roller to ensure proper skid alignment. The anchor handling vessel then progresses forward and water action on the anchor assists in orienting the anchor with the track roller as the winch heaves to board the suction pile anchor which is brought to rest in cradle. Recall FIGS. 4 and 3. The suction anchor vessel proceeds to the next anchor, repeating the recovery procedure.

Another type of batch operations may particularly facilitate developing a deepwater hydrocarbon reservoirs with drilling operations for a plurality of satellite subsea wells at adjacent sites. In this method a deepwater-drilling rig with dynamic positioning capabilities is deployed. The deepwater drilling capabilities of the vessel is enhanced with a mooring system deployment beginning with setting a minimum array of suction pile anchors, e.g., four, and connecting mooring lines from the deepwater drilling rig prior to beginning drilling operations at a first site. Drilling is initiated relying, in part, on the vessel's dynamic positioning system while the anchor handling vessel returns for more suction pile anchors to complete the full complement of suction pile anchors. Returning, the vessel completes the mooring installing, e.g., another four for a total of eight suction pile anchor, and connecting mooring lines from the deepwater drilling rig during drilling operations at the first site.

The anchor handling vessel then returns for another load of suction pile anchors, setting a minimum array of suction pile anchors at a subsequent site while drilling operations are ongoing at the first site. Thereafter, when drilling is complete at the first site, drilling operations cease, the mooring lines are disengaged from the suction anchor piles, and the deepwater drilling rig moves to the subsequent site where it is connected to the minimum array of suction pile anchors already installed at that site. Additional suction pile anchors are retrieved from the first site and installed the subsequent site while drilling operations are ongoing. After the full complement of mooring lines are attached at the subsequent site, the remaining suction pile anchors are retrieved and installed for a minimum support at the next site, as the process repeats.

It will be seen that the present invention is particularly well adapted for use with mobile offshore drilling units or MODUs such as SPAR structures that may be deployed for predrilling deepwater prospects or used for developing satellite sites. For such applications, rapid deployment, retrieval and redeployment is particularly beneficial and the repetitious nature of the application accentuates the economics of minimizing the equipment demands. However, other applications, including those combining long term production or combining drilling and production, may benefit from the present invention.

An illustrative embodiment has been described using a single handling vessel. However, embodiments of the improved suction pile anchors and mooring systems can be deployed using two boats, a second assisting to drag the suction pile anchor off the first and to assist with lowering.

Further, variations are intended with additional capacities and capabilities of anchor handling vessels. Various mooring configurations may also be deployed, with or without buoys, taut, catenary, or combined.

Other modifications, changes, and substitutions are also intended in the foregoing disclosure. Further, in some instances, some features of the present invention will be employed without a corresponding use of other features described in these illustrative embodiments. Accordingly, it is appropriate that the appended claims be construed broadly and in a manner consistent with the spirit and scope of the invention herein.

What is claimed is:

1. A method for deploying a suction pile anchor, comprising:

opening valves on the top of a suction pile;

offloading the suction pule anchor from an anchor boat and lowering the suction pile anchor to a sea floor with a cable;

setting the suction pile anchor down, adjusting the rate of feed to the cable to match the rate of self-penetration of the suction pile anchor into the sea floor;

closing the valves on the top of the suction pile with an ROV;

attaching the ROV with pump capability to a pressure port of the suction pile;

operating a pump of the ROV to draw down the suction pile to full depth, bringing a load pad-eye and an attached first end of a load line well below a mudline of the sea floor;

supporting a load connection at a second end of the load line above the mudline utilizing a keeper on the side of the suction pile;

disconnecting the ROLV from the pressure port; and connecting a mooring line to the load connection with the ROV.

2. The method for deploying the suction pile anchor in accordance with claim 1, further comprising:

disconnecting the mooring line from the load connection with the ROV;

connecting the ROV to the pressure port of the suction pile anchor; and pumping fluid into the suction anchor pile through the pressure port.

3. The method for deploying the suction pile anchor in accordance with claim 2 wherein pumping fluid comprises pumping seawater into the suction pile anchor.

4. The method for deploying the suction pile anchor in accordance with claim 2 wherein pumping fluid comprises injecting air into the suction pile anchor.

* * * * *